US005697267A

United States Patent [19]

Tsai

[11] Patent Number: 5,697,267

[45] Date of Patent: Dec. 16, 1997

[54] SOCKET WRENCH

[76] Inventor: Chen-Chang Tsai, P.O. Box 1750, Taichung, Taiwan

[21] Appl. No.: 379,287

[22] Filed: Jan. 27, 1995

[51] Int. Cl.[6] ..... B25B 13/00

[52] U.S. Cl. ..... 81/59.1; 192/44

[58] Field of Search ..... 81/59.1, 60, 63.1; 192/44, 45

[56] References Cited

U.S. PATENT DOCUMENTS 5,086,673 2/1992 Korty ..... 81/59.1

5,425,291 6/1995 Chang ..... 81/59.1

*Primary Examiner*—James G. Smith

[57] ABSTRACT

A socket wrench is provided between an inner rotary seat thereof and an outer fitting seat thereof with a plurality of slender steel bars, rubber sleeves and resisting bars, which work together to prevent the skidding of the inner rotary seat and the outer fitting seat and to provide a high torsion strength.

2 Claims, 7 Drawing Sheets

SOCKET WRENCH

FIELD OF THE INVENTION

The present invention relates generally to a socket wrench, and more particularly to a socket wrench having a great torsion strength.

BACKGROUND OF THE INVENTION

The conventional socket wrench is generally defective in design in that it is not provided with an adequate torsion strength so as to allow a user of the socket wrench to exert effectively a force on the socket wrench.

SUMMARY OF THE INVENTION

It is therefore the primary objective of the present invention to provide a socket wrench with a plurality of slender steel bars, rubber sleeves and resisting bars, which are all located between an inner rotary seat and an outer fitting seat of the socket wrench for preventing the inner rotary seat and the outer fitting seat from skidding when an external force is exerted on the socket wrench.

It is another objective of the present invention to provide a socket wrench with an upper fitting body capable of causing the inner rotary seat and the outer fitting seat to rotate synchronously.

The foregoing objectives, features and advantages of the present invention will be more readily understood upon a thoughtful deliberation of the following detailed description of the present invention in conjunction with the accompanying drawings.

BRIEF DESCRIPTION OF THE DRAWINGS

FIG. 7-D shows a perspective view of an outer rotary seat in cooperation with the handle of the present invention.

DETAILED DESCRIPTION OF THE INVENTION

Figure 1:
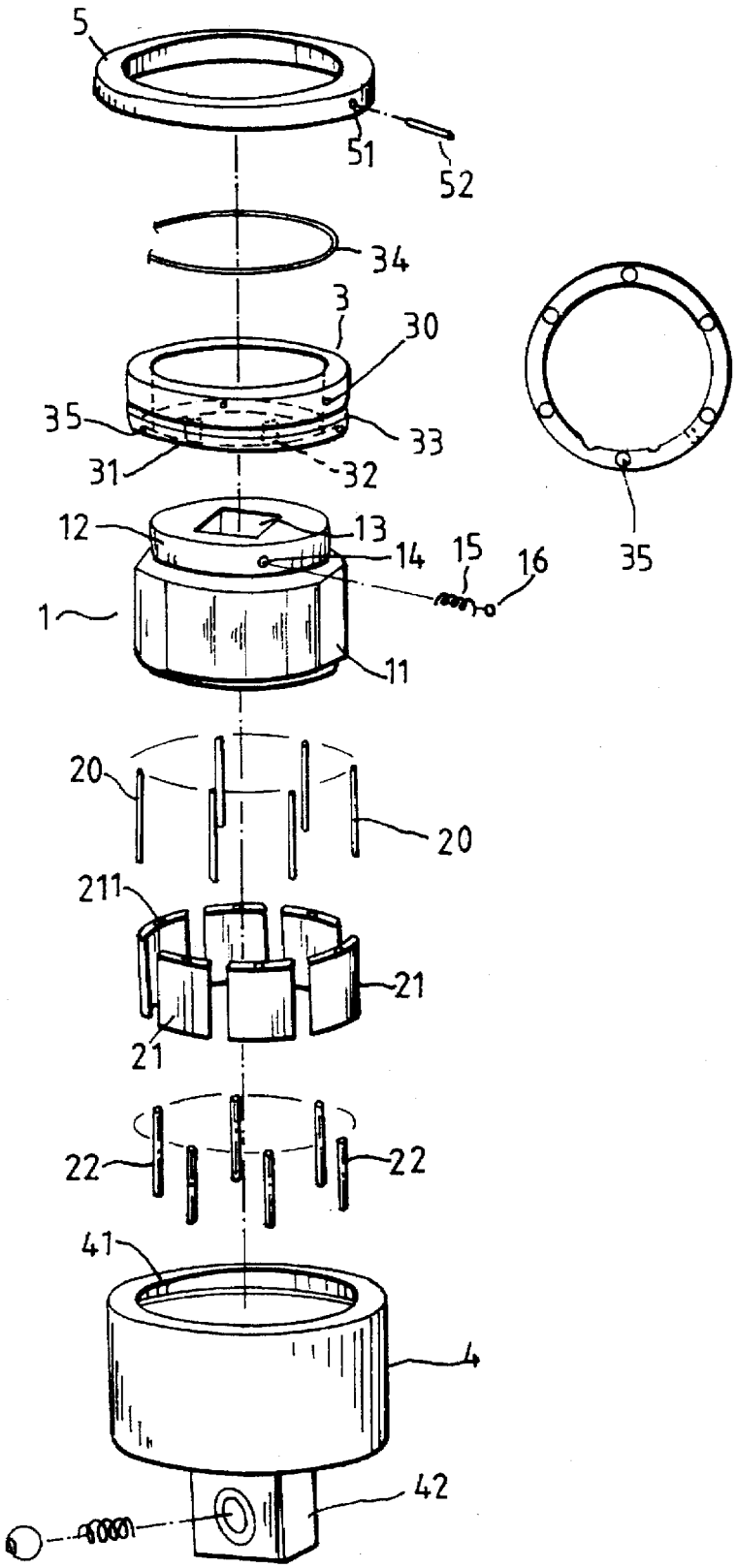
FIG. 1 shows an exploded view of the present invention.
Figure 2:
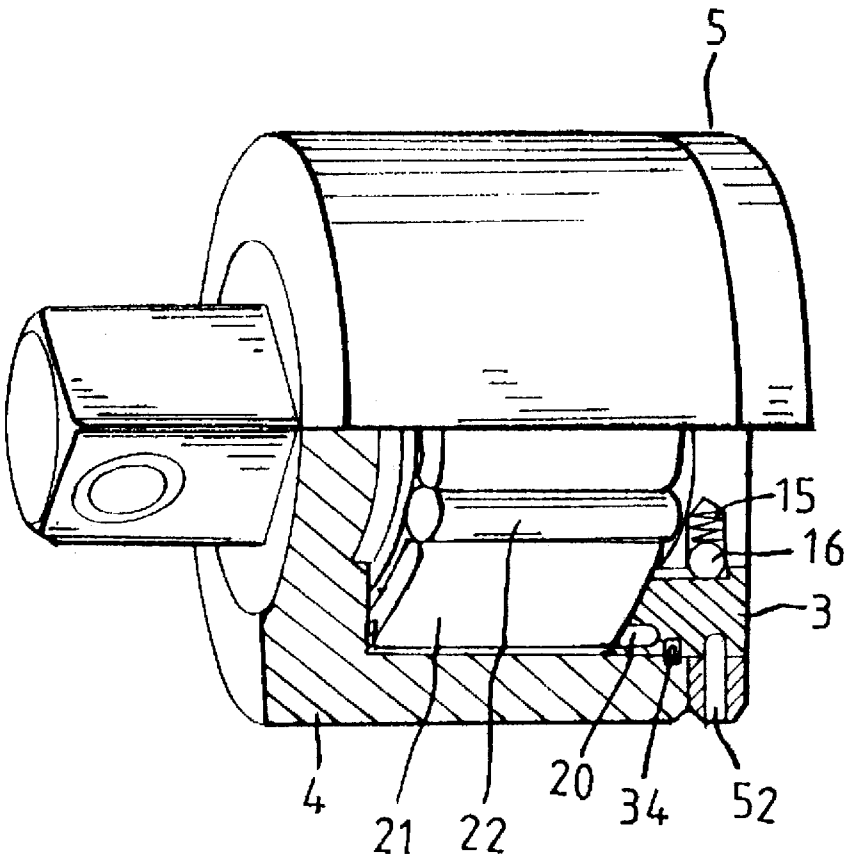
FIG. 2 shows a perspective schematic view of the present invention in combination.
Figure 3:
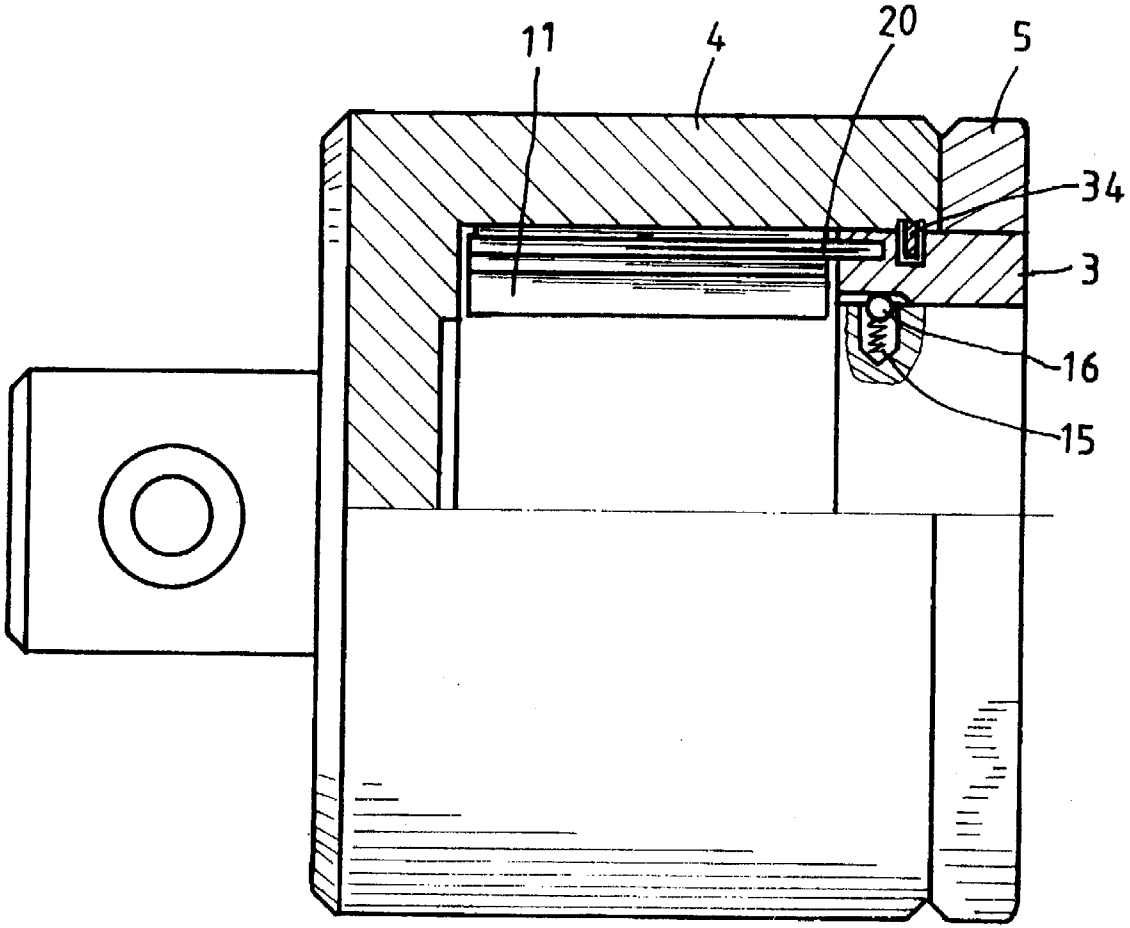
FIG. 3 shows a sectional plan view of the present invention.
Figure 4:
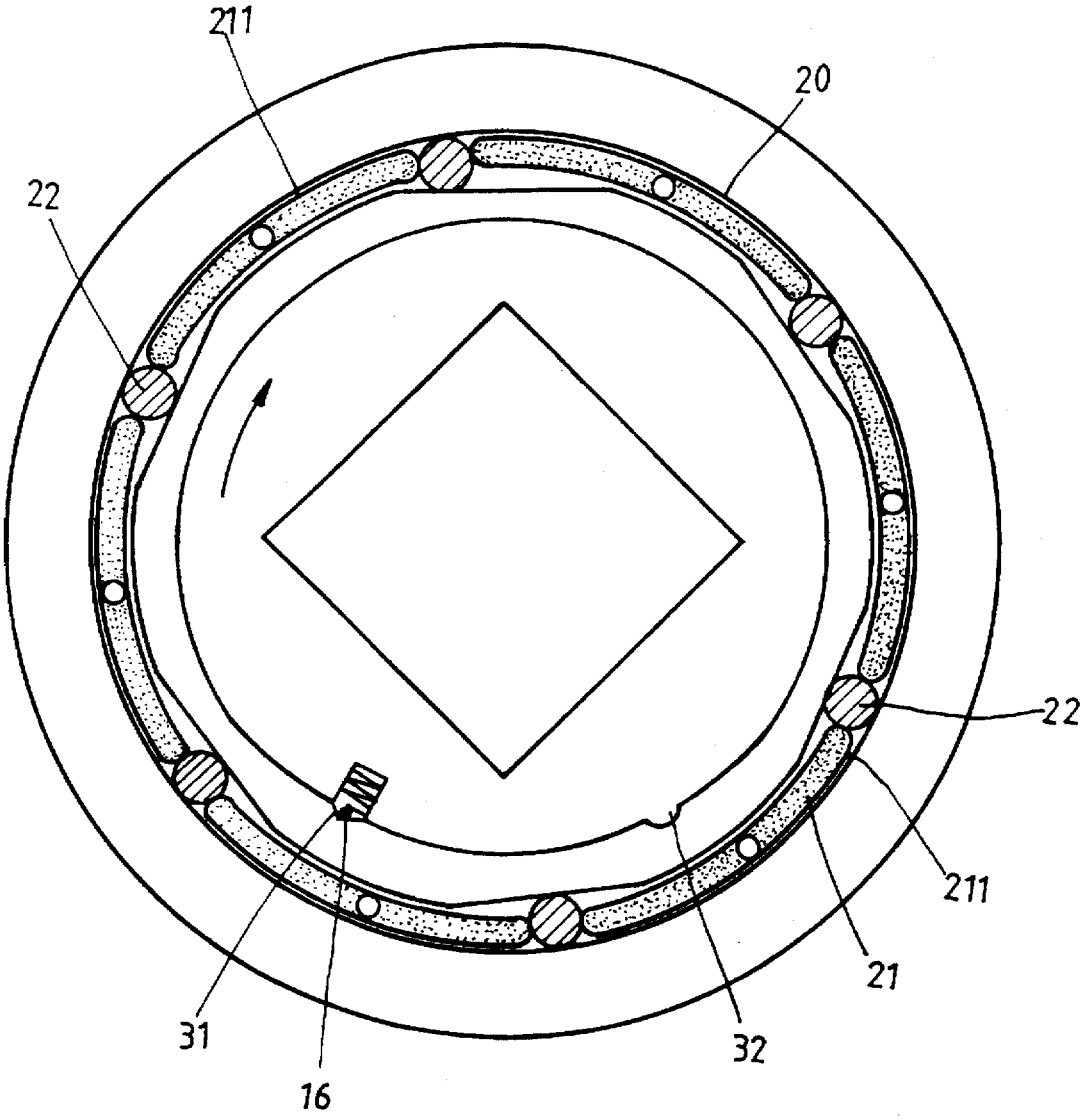
FIG. 4 shows a schematic view of the action of a connection head of the present invention.
Figure 5A:
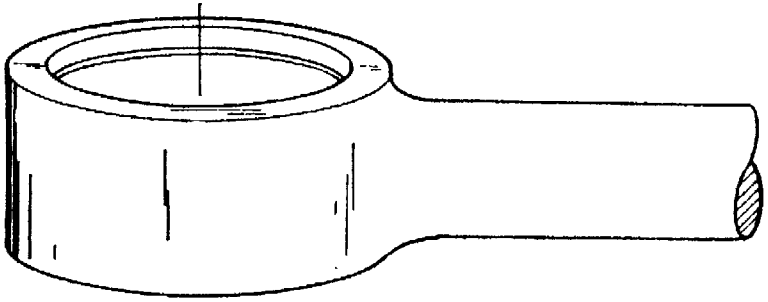
FIG. 5A is an exploded view illustrating an application of the inner rotary seat of the present invention to the socket wrench
Figure 5A:
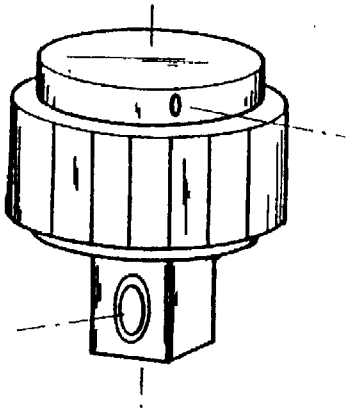
Figure 5:
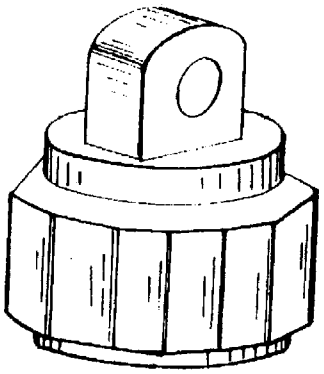
FIG. 5 shows a perspective view of another inner rotary seat of the present invention.
Figure 6:
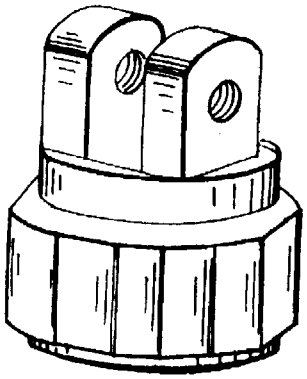
FIG. 6 shows a perspective view of still another inner rotary seat of the present invention.

As shown in all drawings, the socket wrench of the present invention comprises mainly the component parts, which are described explicitly hereinafter.

An inner rotary seat 1 is provided peripherally with a plurality of tangent sides 11 and is further provided on the top thereof with a top ring 12 having a diameter smaller than that of the inner rotary seat 1. The top ring 12 is provided centrally with a square hole 13 dimensioned to receive therein securely a handle. The top ring 12 is further provided with a receiving slot 14 in which a spring 15 and a steel ball 16 are disposed.

An upper fitting body 3 is provided in the inner side thereof with a plurality of locating holes 35 which are spaced equidistantly. The upper fitting body 3 is so dimensioned as to fit over the top ring 12 of the inner rotary seat 1. The upper fitting body 3 is further provided in the inner wall thereof with two insertion recesses 31 and 32 of an arcuate construction for resisting the steel ball 16. The upper fitting body 3 is still further provided in the outer surface thereof with a circular groove 33 in which a retaining member 34 is disposed.

An outer fitting seat 4 is provided on the inner wall thereof with a circular slot 41 and on the underside thereof with an insertion column 42 attached thereto securely for fitting into the socket.

A stopping member 2 comprises a plurality of rubber sleeves 21, resisting bars 22 and slender steel bars 20. The rubber sleeves 21 are provided respectively with a central sleeve 211 in which the slender steel bar 20 is disposed in such a manner that one end of the slender steel bar 20 is located in the locating hole 35 of the upper fitting body 3.

A circular cover 5 is provided peripherally with a through hole 51 in which one end of an insertion pin 52 is received. The insertion pin 52 has another end which is received in a through hole 30 of the upper fitting body 3.

In combination, the stopping member 2 is located between the inner rotary seat 1 and the outer fitting seat 4. Upon being exerted on by an external force, the circular cover 5 is caused to actuate the upper fitting body 3 so as to cause the steel ball 16 to be located in one of the two insertion recesses 31 and 32. The handle is inserted into the inner rotary seat 1 which can be caused to actuate the rubber sleeves 21 which are in turn caused to urge the resisting bars 22, thereby enabling the outer fitting seat 4 to be actuated.

Figures 7A, 7B, 7C, 7D:
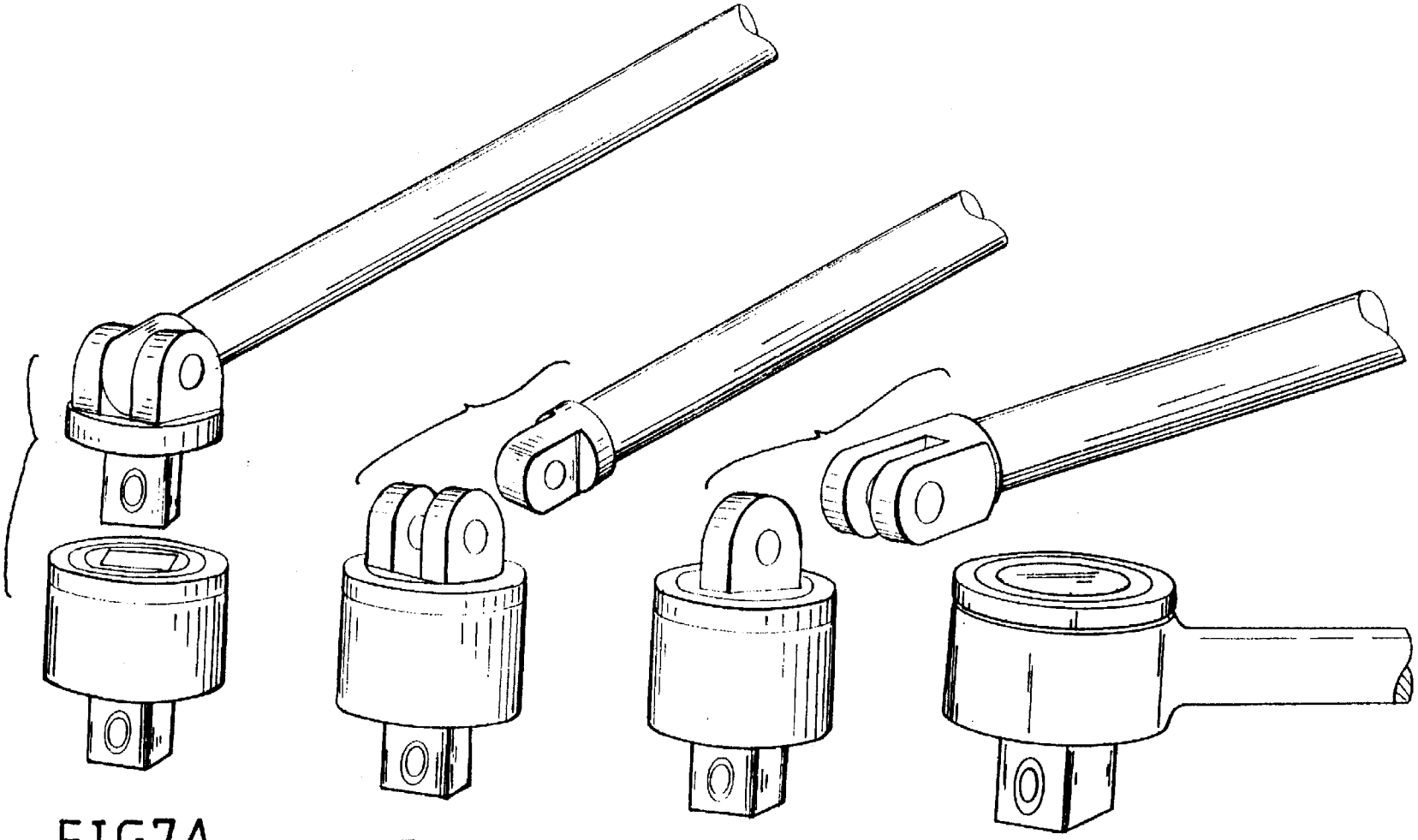
FIGS. 7A, 7B, and 7C are exploded views illustrating three applications of the inner rotary seat in cooperation with the handle of the present invention.
Figure 8:
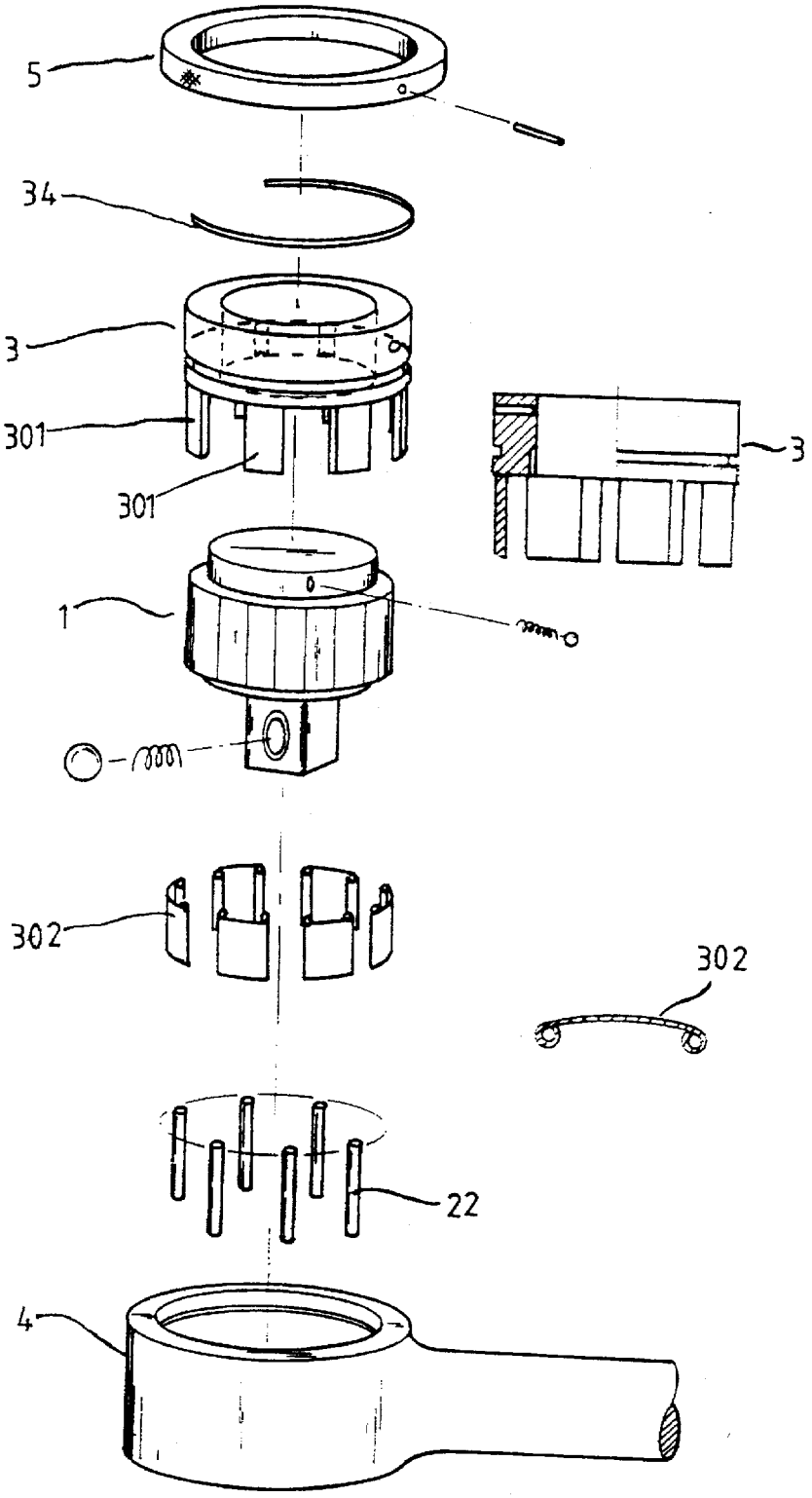
FIG. 8 shows an exploded view of the present invention as shown in FIG. 7-A.

Another embodiment of the present invention is illustrated in FIGS. 7-D and 8, in which the outer fitting seat 4 is the point of application for actuating the inner rotary seat 1. The upper fitting body 3 is provided with a plurality of projections 301 in place of the slender steel bars 20, and with a plurality of spring pieces 302 in place of the rubber sleeves 21. As a result, the socket wrench of the present invention is provided with a high torsion strength when it is at work.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A socket wrench comprising:

an inner rotary seat including an outer peripheral portion having a plurality of tangent sides formed therein, said inner rotary seat including a top ring having a square hole formed therein and having a receiving slot formed therein for receiving a spring and a steel ball therein;

an upper fitting body including an inner side having a plurality of spaced locating holes formed therein, said upper fitting body including an inner wall having two insertion recesses formed therein for engaging with said steel ball and including an outer surface having a circular groove formed therein for engaging with a retaining member, said upper fitting body being dimensioned to fit over said top ring of said inner rotary seat;

an outer fitting seat including an inner wall having a circular slot formed therein and including an insertion column extended therefrom for fitting into a socket, said inner rotary seat being engaged in said outer fitting seat;

a stopping member including a plurality of rubber steel and resisting bars and slender steel bars engaged between said inner rotary seat and said outer fitting seat, said rubber sleeves each including a central sleeve formed therein for engaging with said slender steel bars, said slender steel bars each including a first end engaged in said locating holes of said upper fitting body, said resisting bars being engaged between said rubber sleeves and being engaged between said tangent sides of said inner rotary seat and said inner wall of said outer fitting seat;

a circular cover engaged on said upper fitting body; and an insertion pin engaged in said circular cover and said upper fitting body for securing said circular cover to said upper fitting body, said resisting bars being moved by said rubber sleeves so as to be engaged between said tangent sides of said inner rotary seat and said inner wall of said outer fitting seat for enabling said outer fitting seat to be actuated.

2. A socket wrench comprising:

an inner rotary seat including an outer peripheral portion having a plurality of tangent sides formed therein, said inner rotary seat including a top ring having a square hole formed therein and having a receiving slot formed therein for receiving a spring and a steel ball therein;

an upper fitting body including an inner side having a plurality of spaced locating holes formed therein, said upper fitting body including an inner wall having two insertion recesses formed therein for engaging with said steel ball and including an outer surface having a circular groove formed therein for engaging with a retaining member, said upper fitting body being dimensioned to fit over said top ring of said inner rotary seat and including a plurality of projections extended therefrom, an outer fitting seat including an inner wall having a circular slot formed therein and including an insertion column extended therefrom for fitting into a socket, said inner rotary seat being engaged in said outer fitting seat;

a stopping member including a plurality of spring pieces and resisting bars engaged between said inner rotary seat and said outer fitting seat, said projections being engaged with said spring pieces for moving said spring pieces, said resisting bars being engaged between said rubber sleeves and being engaged between said tangent sides of said inner rotary seat and said inner wall of said outer fitting seat;

a circular cover engaged on said upper fitting body; and an insertion pin engaged in said circular cover and said upper fitting body for securing said circular cover to said upper fitting body, said resisting bars being moved by said spring pieces so as to be engaged between said tangent sides of said inner rotary seat and said inner wall of said outer fitting seat for enabling said outer fitting seat to be actuated.

* * * * *